US010434797B2

(12) United States Patent
Torikata

(10) Patent No.: US 10,434,797 B2
(45) Date of Patent: Oct. 8, 2019

(54) IMAGE FORMING APPARATUS

(71) Applicant: CANON KABUSHIKI KAISHA, Tokyo (JP)

(72) Inventor: Kotaro Torikata, Chigasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/111,526

(22) Filed: Aug. 24, 2018

(65) Prior Publication Data

US 2019/0061378 A1 Feb. 28, 2019

(30) Foreign Application Priority Data

Aug. 25, 2017 (JP) ..... 2017-161730

(51) Int. Cl.

| | |
|---|---|
| ***B41J 11/62*** | (2006.01) |
| ***B41J 11/00*** | (2006.01) |
| ***G03G 15/10*** | (2006.01) |
| ***G03G 15/20*** | (2006.01) |
| *G03G 21/16* | (2006.01) |

(52) U.S. Cl.

CPC ..... *B41J 11/002* (2013.01); *B41J 11/62* (2013.01); *G03G 15/10* (2013.01); *G03G 15/2007* (2013.01); *B41J 11/0085* (2013.01); *G03G 21/16* (2013.01)

(58) Field of Classification Search

CPC ..... B41J 11/002; B41J 11/62; B41J 11/0085; G03G 15/2007; G03G 15/10; G03G 21/16

See application file for complete search history.

(56) References Cited

U.S. PATENT DOCUMENTS

| | | | | |
|---|---|---|---|---|
| 7,997,716 | B2 | 8/2011 | Yokota | |
| 2005/0012778 | A1* | 1/2005 | Nishino | B41J 11/002 347/29 |
| 2010/0149295 | A1* | 6/2010 | Kulpa | B41J 11/002 347/102 |
| 2017/0168406 | A1* | 6/2017 | Sakimura | G03G 5/047 |

FOREIGN PATENT DOCUMENTS

| | | | |
|---|---|---|---|
| JP | 2008-265329 | A | 11/2008 |
| JP | 2008-275300 | A | 11/2008 |

* cited by examiner

*Primary Examiner* — Yaovi M Ameh
(74) *Attorney, Agent, or Firm* — Venable LLP

(57) ABSTRACT

An image forming apparatus includes an image forming portion including an image bearing member, a developing device, and an intermediary transfer belt; a feeding device including a feeding belt; an ultraviolet irradiation portion; a cover; a first shielding plate extending in a direction perpendicular to the feeding direction on a feeding surface of the feeding belt from an inner surface of the cover downwardly with respect to the vertical direction and configured to shield the intermediary transfer belt from the ultraviolet radiation toward the intermediary transfer belt; and a second shielding plate provided on the cover and extending downwardly with respect to the vertical direction along an outer surface of the intermediary transfer belt. The second shielding plate is configured to shield the intermediary transfer belt from the ultraviolet radiation toward the intermediary transfer belt.

4 Claims, 6 Drawing Sheets

IMAGE FORMING APPARATUS

FIELD OF THE INVENTION AND RELATED ART

The present invention relates to an image forming apparatus including a fixing device for fixing a liquid developer on a recording material by irradiation with ultraviolet radiation (UV light).

In a printing machine or a coating device in which a drying device for drying a liquid, such as ink or varnish, supplied to a sheet-like member is provided, conventionally, in printing units each including a printing cylinder, a rubber cylinder and an impression cylinder, a toner surface of a print (printed matter) immediately after being subjected to printing between the impression cylinder and the rubber cylinder is dried by an ultraviolet (UV) lamp provided at a position opposing the impression cylinder (example A), or a drying unit including a feeding cylinder and a UV lamp provided at a position opposing the feeding cylinder is provided separately from the printing unit for a plurality of colors, a print surface of a print subjected to printing between an impression cylinder and a rubber cylinder of each of the printing units for the plurality of colors is dried by the drying unit at a position downstream of the printing units with respect to a paper (sheet) feeding direction immediately after the paper passed through the printing unit (example B).

In the case of the example A, there is a problem that the ultraviolet radiation emitted from the UV lamp onto the print surface for drying the print surface is reflected and cures the ink, the varnish or the like which is curable on the printing cylinder and the rubber cylinder. In the case of the example B, although the problem of the example A can be solved, there are problems that the print surface is damaged by contact of the print surface with the plurality of feeding cylinders before drying or the ink or the varnish is peeled off of the print and is deposited on the feeding cylinders and then a subsequent print surface is contaminated with the ink or the varnish and that the printing units and the drying unit are spaced from each other and thus a full length of a device (apparatus) becomes long.

In view of the above problems, Japanese Laid-Open Patent Application 2008-275300 has proposed a constitution in which not only the problems of the example B are solved by providing a drying portion including a UV lamp immediately behind a printing portion of each of the printing units, but also the problem of the example A is solved by shielding the print surface from the ultraviolet radiation emitted from the UV lamp.

Specifically, each of the printing units includes a feeding cylinder including a means which receives and holds the print immediately after being subjected to printing by the printing portion, and includes a UV lamp for drying the print surface inside the feeding cylinder at a position opposing the print surface of the print held by a print holding portion of the feeding cylinder. Reflected light, by the print, of the ultraviolet radiation emitted from an inside of the feeding cylinder is shielded by a shielding plate covering an upper surface and a side surface of the UV lamp, so that leakage of the reflected light toward the printing cylinder and the rubber cylinder which are provided on the feeding cylinder side is prevented.

In a liquid development electrophotographic apparatus using a liquid developer as a developer, in the case where toner images formed on a plurality of photosensitive members provided for respective colors are transferred onto an intermediary transfer belt and thereafter are transferred from the intermediary transfer belt onto a print and then a print surface of the print is cured by irradiation with ultraviolet radiation by an ultraviolet (UV) irradiation device, when the print is fed by nipping a print surface by feeding rollers in a period from after image transfer from the intermediary transfer belt onto the print until the toner images are cured (fixed) by the UV irradiation device, there is a liability that the images on the print surface are damaged or a print surface of a subsequent print is contaminated with a part of the images peeled off of the print surface toward the feeding roller on the print surface side. Accordingly, it is desired that the print is placed on and fed by a belt while attracting a back-surface side of the print surface to a belt surface by air and then the toner images on the print surface (toner image surface) of the print are cured by passing the print under the ultraviolet radiation by the UV irradiation device.

Further, in the case where air attraction belt feeding is carried out, when a print low in flexibility is passed through a feeding path having upwardly convex curvature or downwardly convex bending, there arise problems such as improper feeding due to improper attraction of the print and contact of the print surface with a member, provided on a side above a feeding portion, due to raising of a trailing end of the print, and therefore, it is desirable that the air attraction belt feeding is carried out along a straight feeding path.

In this case, on a side above the feeding path, there is a need that a member provided on the side above the feeding path is disposed with a distance such that the print does not contact the member even when for example, at an end portion of the print, flexure such as a curl or the like which cannot be completely attracted by air suction exists on the print. That is, on the feeding path, there is a space extending from the intermediary transfer belt to the UV irradiation device (i.e., there is a space in which there is a possibility that reflected light from the print surface irradiated with the ultraviolet radiation emitted from the UV irradiation device).

Particularly, in the case where the device is intended to be made compact by shortening a distance from an image transfer position, from the intermediary transfer belt onto the print, to the UV irradiation device, the ultraviolet radiation reflected by the surface of the print reaches an excessive developer remaining on the intermediary transfer belt and the developer is cured in a deposited state on the intermediary transfer belt, so that there are liabilities that improper cleaning occurs in a cleaning operation for the excessive developer remaining on the intermediary transfer belt and that the intermediary transfer belt is broken.

SUMMARY OF THE INVENTION

A principal object of the present invention is to provide an image forming apparatus in which even in a constitution having a gap (spacing) through which a recording material on a belt for feeding the recording material passes, ultraviolet radiation emitted from an ultraviolet irradiation device does not readily reach an intermediary transfer belt by reflection thereof by the belt.

According to an aspect of the present invention, there is provided an image forming apparatus comprising: an image forming portion including an image bearing member, a developing device configured to form a toner image on an image bearing member with a liquid developer including toner, and an intermediary transfer belt onto which the toner image is transferred from the image bearing member; a feeding device including a feeding belt configured to feed a recording material on which the toner image is transferred from the intermediary transfer belt, while carrying the recording material on a surface thereof; an ultraviolet irradiation portion arranged with the intermediary transfer belt in a horizontal direction while opposing the feeding belt and configured to irradiate the toner image, with ultraviolet radiation, formed on the recording material carried on the feeding belt; a cover provided below the image bearing member with respect to a vertical direction and configured to cover at least a feeding surface of the feeding belt between the ultraviolet irradiation portion and the intermediary transfer belt with respect to a feeding direction on a side where the cover opposes the ultraviolet irradiation portion; a first shielding plate extending in a direction perpendicular to the feeding direction on the feeding surface from an inner surface of the cover downwardly with respect to the vertical direction and configured to shield the intermediary transfer belt from the ultraviolet radiation toward the intermediary transfer belt; and a second shielding plate provided on the cover while facing the intermediary transfer belt and extending downwardly with respect to the vertical direction along an outer surface of the intermediary transfer belt, wherein the second shielding plate is configured to shield the intermediary transfer belt from the ultraviolet radiation toward the intermediary transfer belt.

Further features of the present invention will become apparent from the following description of exemplary embodiments with reference to the attached drawings.

DESCRIPTION OF EMBODIMENTS

Embodiments of the present invention will be described with reference to the drawings, but the present invention is not limited to the following embodiments.

Embodiment 1

<Image Forming Apparatus>

Figure 1:
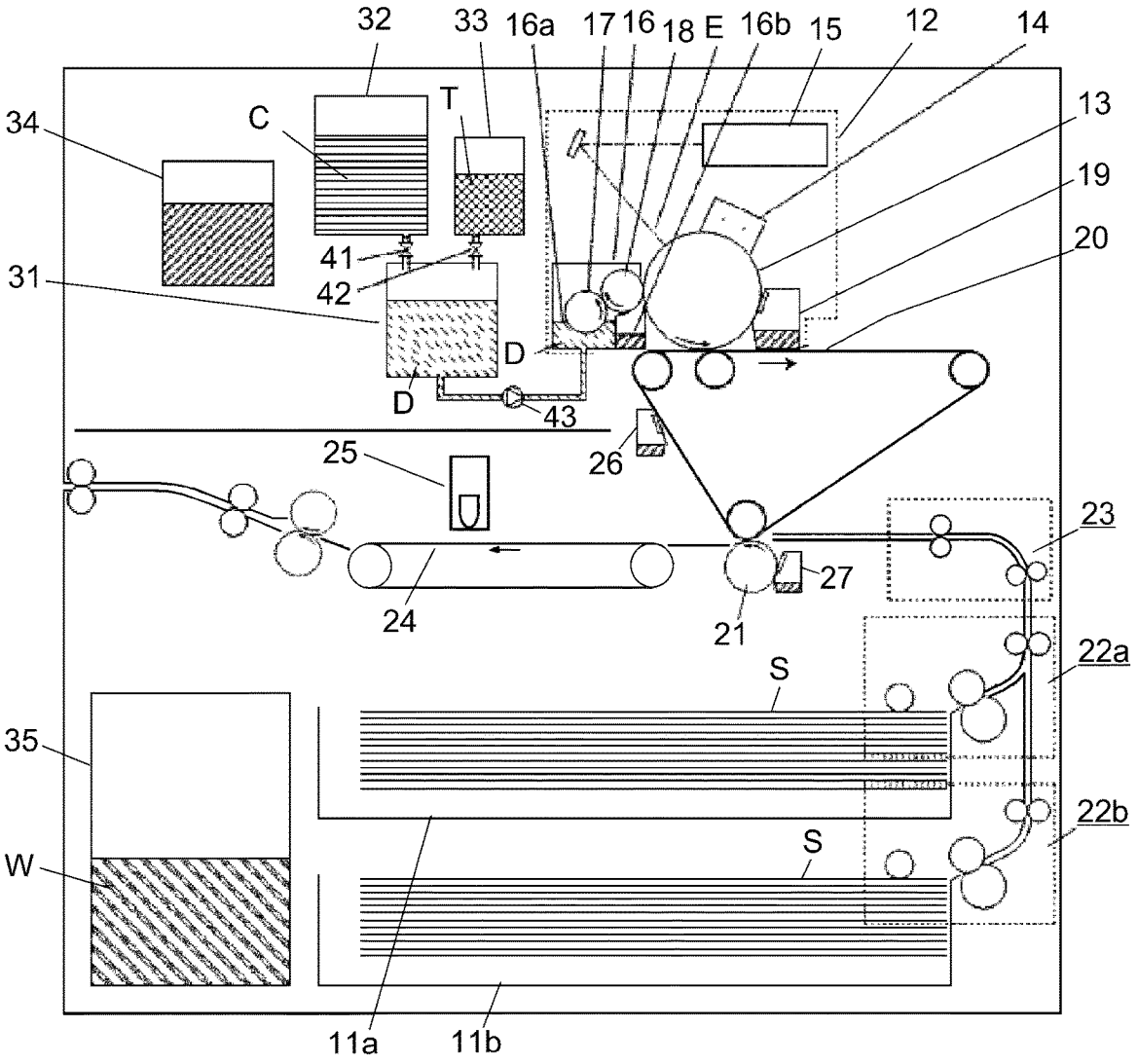
FIG. 1 is a sectional view showing a schematic structure of an image forming apparatus in an embodiment of the present invention.

FIG. 1 is a schematic view of an image forming apparatus according to Embodiment 1 of the present invention.

The image forming apparatus shown in FIG. 1 is a digital printer 10 of an electrophotographic type in which a toner image is formed on a sheet. The digital printer 10 operates on the basis of an image forming signal, and in the printer 10, toner images formed by an image forming portion 12 are transferred onto sheets S successively fed from sheet cassettes 11*a* and 11*b* and then are fixed, so that images are obtained.

In the image forming portion 12, a photosensitive drum 13, a charger 14, a laser exposure device 15, a developing device 16 and a drum cleaner 19 are provided, and the toner image depending on the image forming signal is formed on the photosensitive drum 13. The toner image is obtained by developing an electrostatic latent image, formed by exposure to laser light E, with a liquid developer D in which powdery toner is dispersed in a thermosetting (heat-curable) liquid carrier.

The liquid developer D is formed in a mixer 31 by mixing and dispersing toner T in a liquid carrier C with a predetermined ratio and is supplied to the developing device 16. The liquid carrier C and the toner T are stored in a carrier tank 32 and a toner tank 33, respectively, and are supplied to the mixer 31 depending on a mixing state of the liquid carrier C and the toner T in the mixer 31.

The liquid developer D supplied from the mixer 31 to the developing device 16 is coated on a developing roller 18 by a coating roller 17 in a supplying section 16*a* of the developing device 16 and is used for developing the electrostatic latent image. The liquid carrier C and the toner T which remain on the developing roller 18 after the development are collected in a collecting section 16*b* of the developing device 16.

A toner image formed on the photosensitive drum 13 is transferred onto an intermediary transfer belt 20 and is fed to a nip formed by the intermediary transfer belt 21 and a transfer roller 21. The toner T and the liquid carrier C which remain on the photosensitive drum 13 after the transfer of the toner image onto the intermediary transfer belt 20 is collected by the drum cleaner 19.

Sheet feeding portions 22*a* and 22*b* feed sheets S, stacked on the sheet cassettes 11*a* and 11 b, respectively, to a registration feeding portion 23. The registration feeding portion 23 feeds the sheet to the nip between the intermediary transfer belt 20 and the transfer roller 21 in synchronism with timing of the toner image transferred on the intermediary transfer belt 20.

At the nip between the intermediary transfer belt 20 and the transfer roller 21, the toner image is transferred onto the sheet S passing through the nip, and the sheet S on which the toner image is transferred is fed to a fixing device (UV irradiation device) 25 by a feeding belt of a feeding portion 24.

The fixing device (UV irradiation device) 25 fixes the toner image transferred on the sheet S (i.e., cures the toner image on the sheet S) by ultraviolet radiation, and the sheet S on which the toner image is fixed is discharged to an outside of the image forming apparatus, so that an image forming step is completed.

The intermediary transfer belt 20 and the transfer roller 21 are provided with an intermediary transfer belt cleaner 26 and a transfer roller cleaner 27, respectively, for collecting the remaining toner and the remaining liquid carrier C.

The liquid developer D including the toner T and the liquid carrier C which remain on the developing roller 18 after the development and which are collected in the collecting section 16*b* of the developing device 16, and the liquid developer D including the toner and the liquid carrier C which are collected by the drum cleaner 19, the intermediary transfer belt cleaner 26 and the transfer roller cleaner 27 are separated into a reusable carrier and other components by a separation and extraction device 34 and the reusable carrier is used again.

Further, when the carrier and the toner are separated by the separation and extraction device 34, a deteriorated carrier, the deteriorated toner and impurities which are separated as a waste liquid, and then the waste liquid is collected in a waste liquid collecting container 35.

<Liquid Feeding System>

Figure 2:
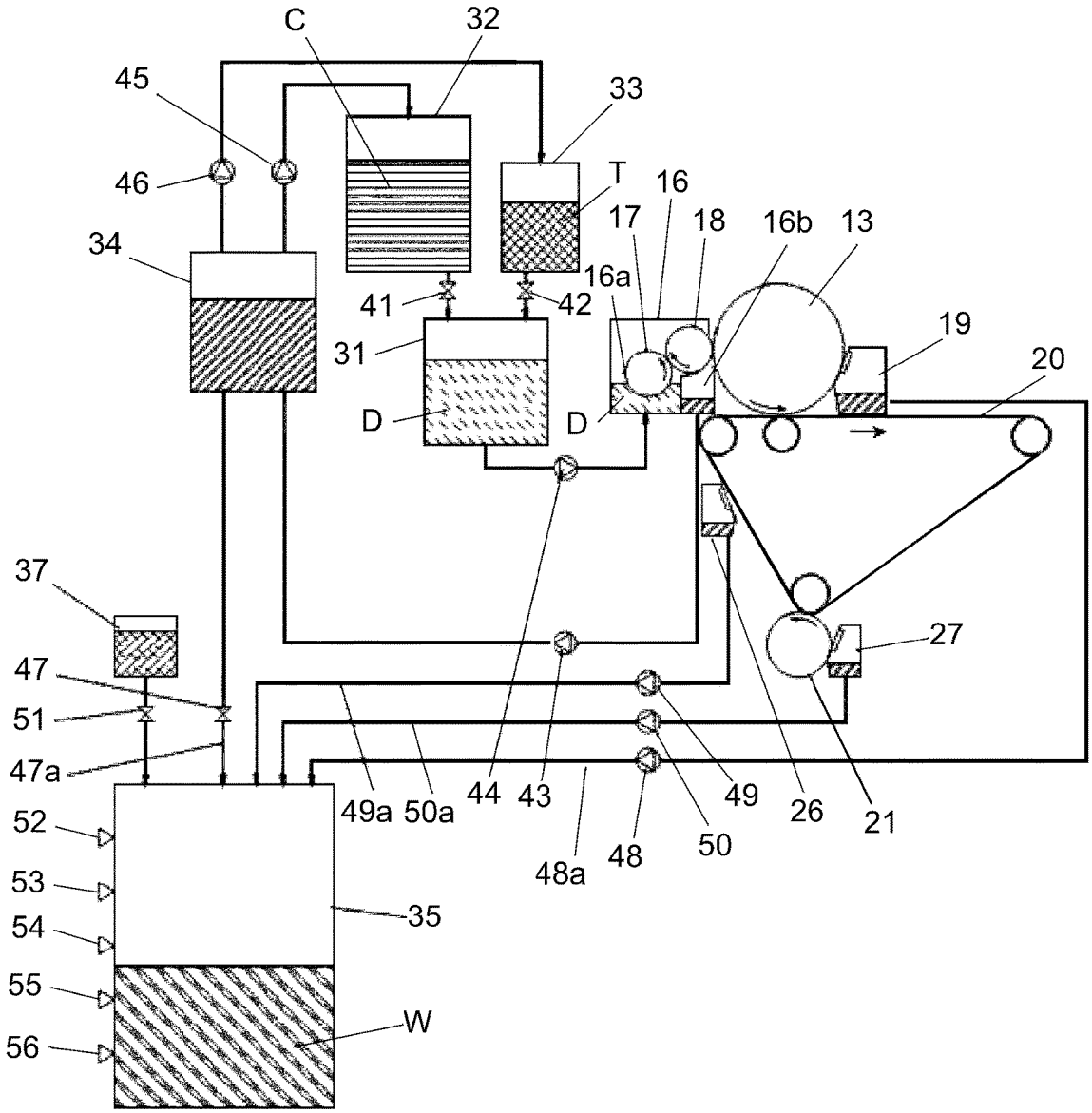
FIG. 2 is a schematic view showing a liquid feeding path of the image forming apparatus in the embodiment.

FIG. 2 shows a schematic view of a liquid feeding path of a liquid feeding system for feeding the developer, the waste liquid and the like.

Transferring pipes from a carrier tank (container) 32 and a toner tank (container) 33 to the mixer 31 are provided with solenoid (-controlled) valves 41 and 42, respectively, and the solenoid valves 41 and 42 adjust supply amounts of the liquid carrier C and the toner to the mixer 31, respectively. From the mixer 31, the liquid developer D necessary for the development is supplied to the developing device 16 by using a pump 44.

The developer collected in the collecting section 16*b* of the developing device 16 is fed to the separation and extraction device 34 by the pump 43, and the liquid developer D, including the remaining liquid carrier C and the toner T, collected by each of the drum cleaner 19, the intermediary transfer belt cleaner 26 and the transfer roller cleaner 27 is also fed to the separation and extraction device 34 by associated one of pumps 48, 49 and 50.

In this embodiment, the liquid developer D is fed using the pumps, but in the case where the liquid developer D can be moved by self-weight fall (free fall), a feeding system using self-weight without providing the pump may also be employed.

The reusable carrier is fed from the separation and extraction device 34 to the carrier tank 32 by a solenoid valve 45. The waste liquid separated by the separation and extraction device 34 is appropriately fed to the waste liquid collecting container 35 by the self-weight fall through a solenoid valve 47 provided in the transporting pipe.

<Sheet Feeding Portion in Section from Toner Image Transfer from Intermediary Transfer Belt to Irradiation of Ultraviolet Radiation by UV Irradiation Device>

Figure 3A:
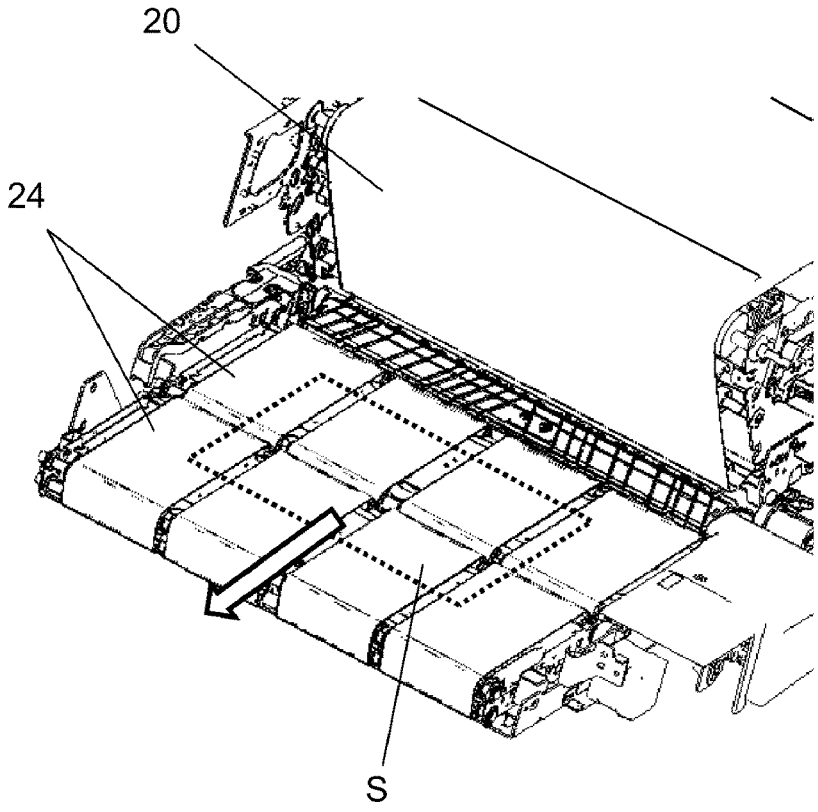
FIG. 3A is a perspective view showing a feeding portion for feeding a sheet S in a section from transfer of a toner image from an intermediary transfer belt to irradiation with ultraviolet radiation by an ultraviolet irradiation device in the embodiment.
Figure 3B:
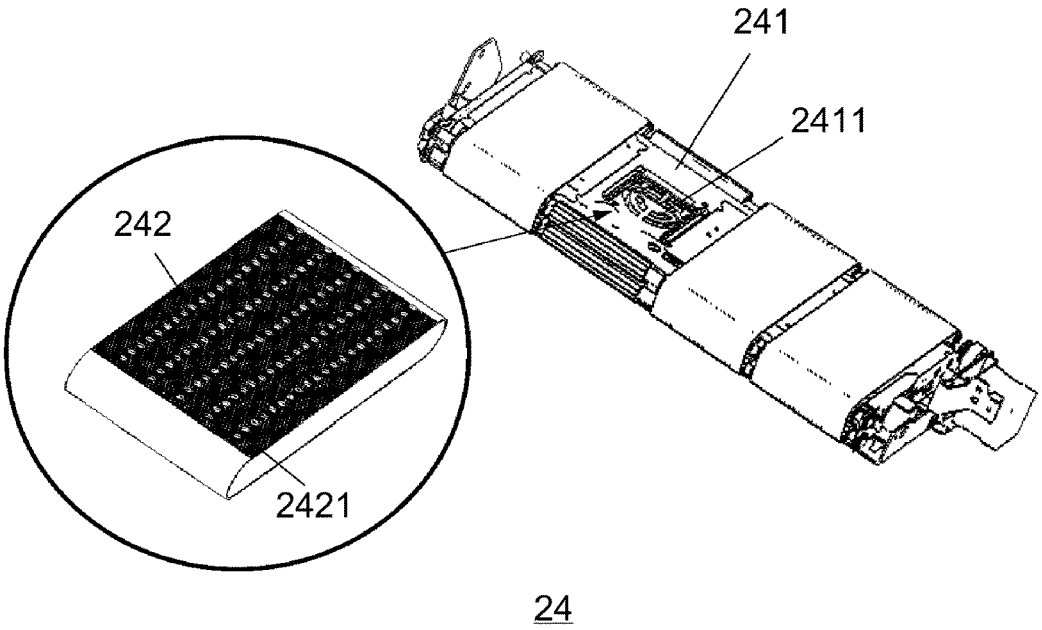
FIG. 3B is a perspective view showing the feeding portion for feeding the sheet S in the section from transfer of the toner image from the intermediary transfer belt to irradiation with the ultraviolet radiation by the ultraviolet irradiation device in the embodiment.

FIG. 3A is a perspective view of the feeding portion 24 for feeding the sheet S in a section from the toner image transfer from the intermediary transfer belt 20 to irradiation of ultraviolet radiation by the UV irradiation device. FIG. 3B is a perspective view of the feeding portion 24 in a partially enlarged form.

When the sheet S passes through a nip N between the intermediary transfer belt 20 and the transfer roller 21, an unfixed (uncured) toner image is placed on the sheet S. At this time, for example, in the case where a toner image surface side is nipped with a roller in order to feed the sheet S, there is a liability that the toner image is damaged and a part of the toner image peeled off of the sheet S toward the feeding roller side transfers to a subsequence sheet and a toner image surface of the subsequent sheet is contaminated therewith. For that reason, the sheet S on which the toner image is transferred from the intermediary transfer belt 20 is fed to an endless feeding belt 242 in a rotational direction (arrow direction in FIG. 3A) of the feeding belt 242 in a state in which a back-surface opposite from the unfixed (uncured) toner image surface is attracted by air. At this time, there is no member contacting the toner image surface and therefore there is no liability that the toner image surface is damaged or contaminated with the toner image transferred to the feeding roller.

A constitution of attraction by the air will be described.

As shown in FIG. 3B, the feeding belt 242 for feeding the sheet S placed thereon is provided with a plurality of holes 2421, and a feeding unit frame 241 for supporting the feeding belt 242 by rollers is provided with a plurality of holes 2411 in a surface on a side where the sheet S is to be fed. The air sucked by a suction fan attracts the sheet S to the feeding belt 242 through the holes 2411 of the feeding unit frame 241 and the holes 2421 of the feeding belt 242.

In the case where attraction feeding by the air is carried out, when a constitution in which the feeding path has upwardly convex curvature or a feeding unit is divided into feeding belts with respect to a feeding direction and the divided belts for delivering the sheet S therebetween have a V-character relationship is employed, there is a liability that in the case where the sheet S having flexibility which is not high is fed, improper feeding due to incomplete attraction of the sheet S by the feeding belts and damage of the toner image surface, on the sheet S, contacting peripheral members provided above the feeding portion due to a trailing end curling phenomenon that a trailing end of the sheet S curls toward a side where the trailing end is spaced from the feeding belt. For that reason, the feeding path along which the air attraction feeding is carried out is formed straightly (as a feeding path along which the sheet S is straightly fed without bending the sheet S).

<UV Irradiation Device>

Figure 4A:
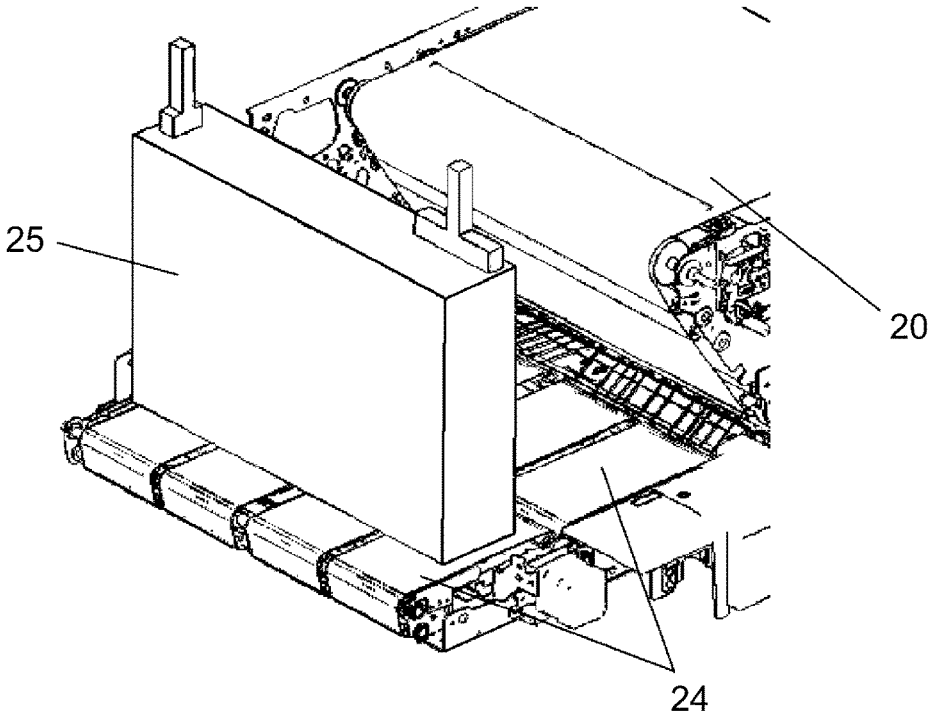
FIG. 4A is a perspective view showing an arrangement of the ultraviolet irradiation device relative to the feeding portion and showing a positional relationship between the ultraviolet irradiation device and the intermediary transfer belt in the embodiment.
Figure 4B:
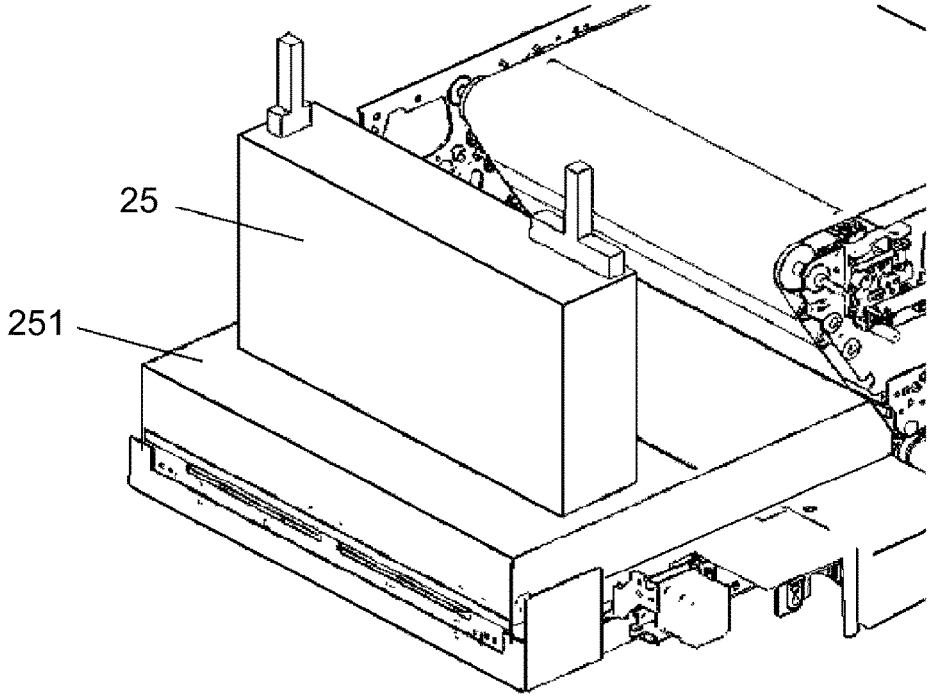
FIG. 4B is a perspective view showing an arrangement of the ultraviolet irradiation device relative to the feeding portion and showing the positional relationship between the ultraviolet irradiation device and the intermediary transfer belt in the embodiment.
Figure 4C:
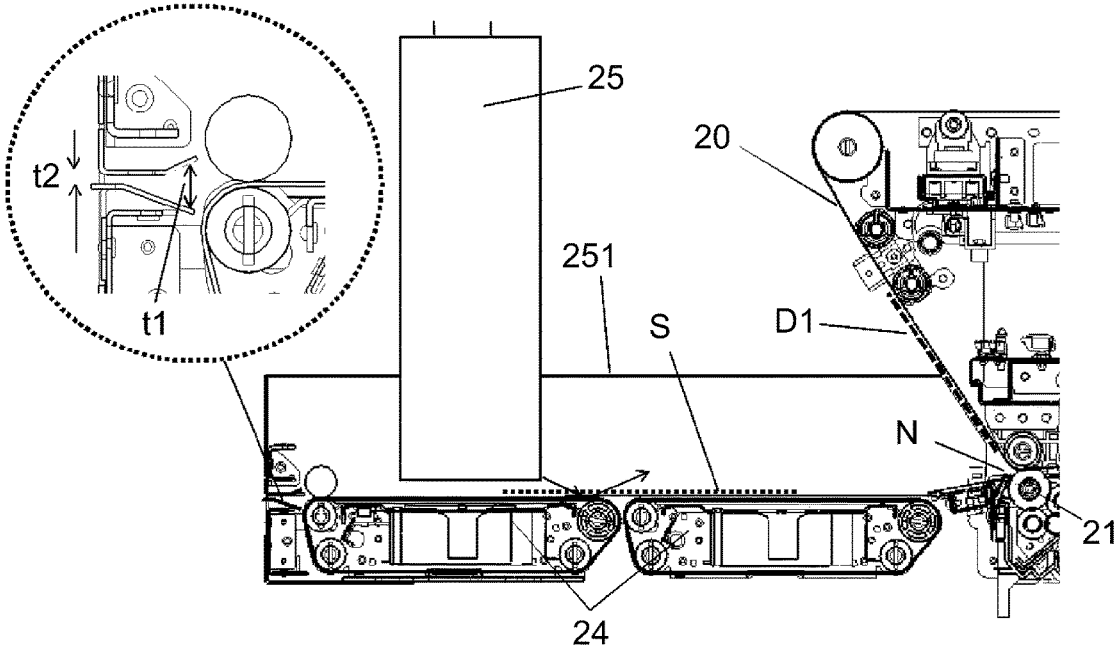
FIG. 4C is a sectional view showing an arrangement of the ultraviolet irradiation device relative to the feeding portion and showing the positional relationship between the ultraviolet irradiation device and the intermediary transfer belt in the embodiment.

FIGS. 4A and 4B are perspective views and FIG. 4C is a sectional view, in which an arrangement of the UV irradiation device 25 relative to the feeding portion 24 and a positional relationship of the UV irradiation device 25 with the intermediary transfer belt 20 are shown.

The UV irradiation device 25 for fixing (curing) the toner image (formed with the developer having a UV curable characteristic) transferred on the sheet S is provided perpendicularly above a feeding surface of the feeding portion 24, and the toner image on the surface is fixed (cured) by passing the sheet through below UV radiation (light), emitted from the UV irradiation device 25 toward the feeding surface side, by the feeding portion 24.

The UV irradiation device 25 uses a UV-LED as a UV irradiation source but may also be a UV lamp.

As shown in FIGS. 4B and 4C, in order to prevent leakage of UV leakage light to an outside of a region between the UV irradiation device 25 and the feeding portion 24, a cover 251 for covering a periphery of the region can be provided. In this embodiment, the cover 251 includes side walls which are parallel to the sheet feeding direction of the feeding portion 24 and which are perpendicular to the feeding surface, and includes a ceiling wall parallel to and spaced from the feeding surface with a distance (for example, 10 mm or more) in which even when an end portion of the sheet S includes a curled portion or the like which cannot be attracted by the feeding portion 24 during feeding of the sheet S, the toner image surface of the sheet S is prevented from contacting the ceiling wall and from being damaged and caught by the ceiling wall during feeding of the sheet S.

In this embodiment, the toner image surface of the sheet S passed through the UV radiation from the UV irradiation device 25 is fixed (cured), and therefore, in a subsequent feeding path after passed below the UV irradiation device 25, even when the toner image surface contacts the rollers for feeding the sheet S and a guide for feeding the sheet S, there is no liability that the toner image surface is damaged, so that a feeding roller for nipping the toner image surface S is provided.

Further, feeding of the sheet S by the feeding roller is higher in feeding force than feeding of the sheet S by a belt through attraction with the air, and therefore, the sheet S is fed by being slid on a feeding guide surface on a side downstream of the feeding roller for nip-feeding the sheet S.

Further, a constitution in which an opening, between the cover 251 and the feeding surface with respect to a perpendicular direction, which is a gap between upper and lower feeding guides at an exit of the cover 251 and through which the sheet S passes is narrowed is employed. Specifically, on a side downstream of the feeding roller with respect to the feeding direction, a guide is provided so that the gap between the feeding guides becomes narrow toward a downstream side with respect to the feeding direction in a beak shape (t1>t2) and an opening, of the cover 251, through which the sheet S is fed is narrowed (for example, an opening width t2 is 3 mm). In this embodiment, in the feeding path downstream of the UV irradiation device 25, the opening is narrowed, so that leakage of the UV leakage light, emitted from the UV irradiation device 25, to the outside is prevented by the cover 251, the feeding rollers, unshown members for supporting the feeding rollers and the feeding guides.

On the other hand, on the feeding portion 24 for feeding the sheet S in a section from the toner image transfer from the intermediary transfer belt 20 to the irradiation with the UV radiation by the UV irradiation device 25, light beams of the UV radiation (principally, light reflected by a surface of the sheet S opposing the UV irradiation device 25, i.e., the toner image surface; general reflectance of white paper: 60%-90%) pass toner between the feeding portion 24 and the ceiling wall of the cover 251.

On an upstream side of the feeding direction where reflected light beams of the UV radiation from the UV irradiation device 25 pass, there is a liability that a surface of the intermediary transfer belt 20 downstream of the nip N between the intermediary transfer belt 20 and the transfer roller 21 for transferring the toner image onto the sheet S is exposed to the reflected light beams. Particularly, in the case where in order to make an entirety of the image forming apparatus compact, the feeding portion 24 for feeding the sheet S in the section from the toner image transfer from the intermediary transfer belt 20 to the irradiation with the UV radiation from the UV irradiation device 25 is shortened, a liability that the intermediary transfer belt surface is exposed to the reflected light beams becomes high. On the surface of the intermediary transfer belt 20 downstream of the nip N, the remaining liquid developer Dl including transfer residual toner T and the liquid carrier C after the toner image transfer onto the sheet S is placed. When the remaining liquid developer D1 is exposed to the reflected light beams of the UV radiation until the remaining liquid developer D1 is collected by an unshown intermediary transfer belt cleaner, the remaining liquid developer D1 is cured in a deposited state on the intermediary transfer belt 20, so that there is a liability that breakage of the intermediary transfer belt 20 and improper cleaning by the intermediary transfer belt cleaner are caused to occur.

<Shielding Plates>

Figure 5A:
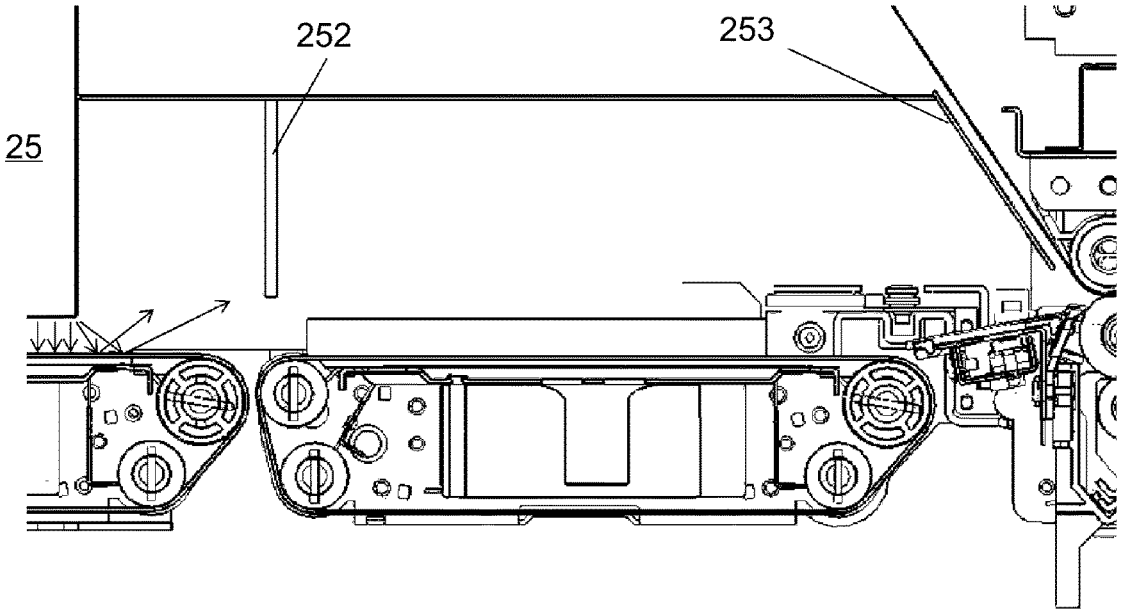
FIG. 5A is a schematic view for illustrating a shielding plate for shielding reflected light of the ultraviolet radiation in the embodiment.
Figure 5B:
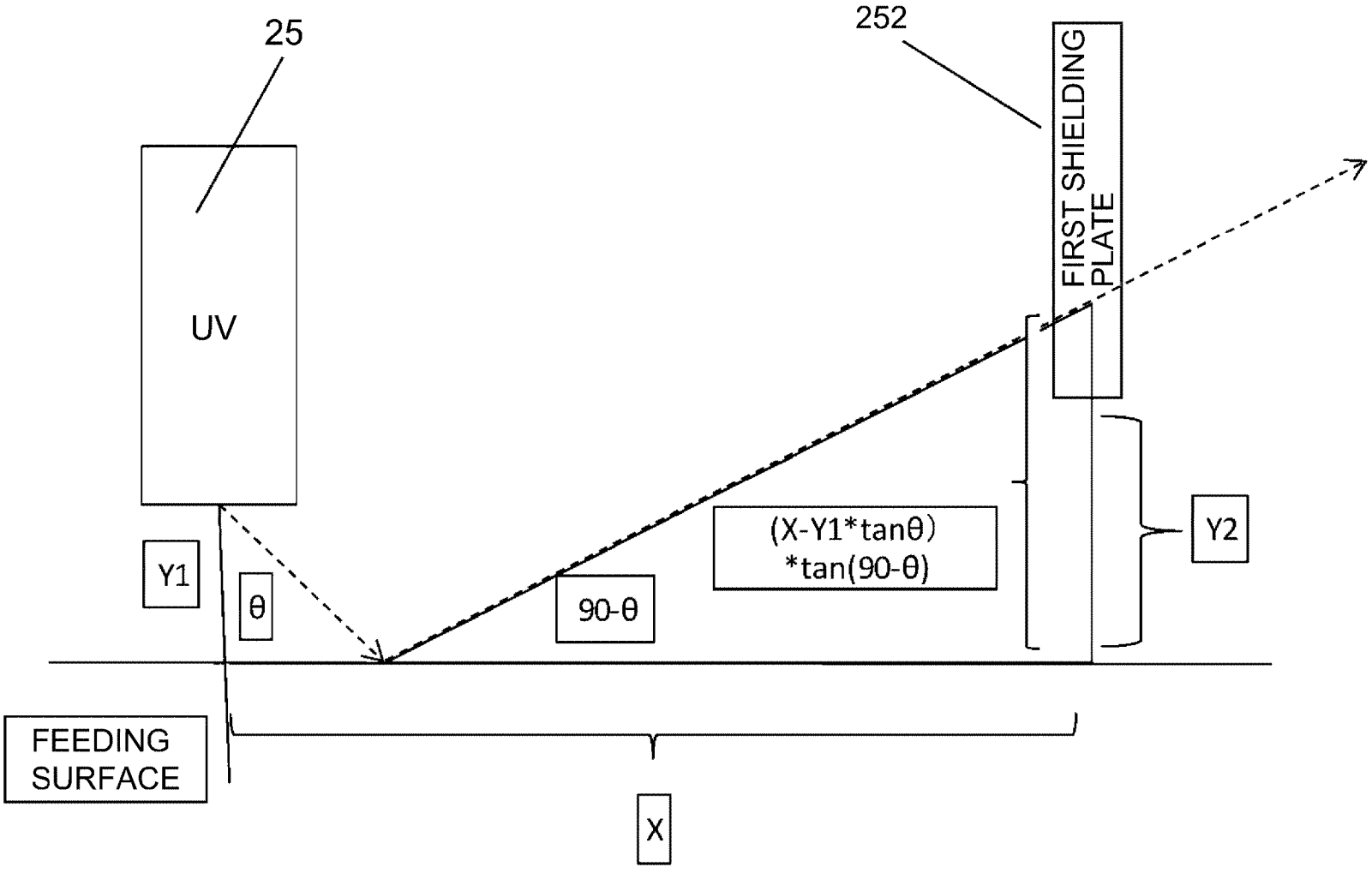
FIG. 5B is a schematic view for illustrating the shielding plate for shielding the reflected light of the ultraviolet radiation in the embodiment.

Shielding plates as a feature of the present invention will be described with reference to FIGS. 5A and 5B.

A UV irradiation source of the UV irradiation device 25 has directivity (directional characteristic), so that when an optical axis center is taken as 0 degrees, a radiation angle is ±0 degrees (for example, when the optical axis center is 0 degrees as an example thereof in the UV-LED, the radiation angle is ±60 degrees).

A first shielding plate 252 is provided perpendicularly to the feeding surface in a section between a position of the toner image transfer from the intermediary transfer belt 20 and the UV irradiation device 25. The first shielding plate 252 in this embodiment is formed of a UV absorber (absorbing agent) (for example, a resin material containing a benzotriazole-based UV absorber). The first shielding plate 252 increases in a range, in which reflected light by the sheet S expands, with a distance from the UV irradiation device 25, and therefore, the first shielding plate 252 may desirably be provided in the neighborhood of the UV irradiation device 25. On the other hand, a distance Y2 from the feeding surface (toner image surface of the sheet S) to a lower end of the first shielding plate 252 opposing the feeding surface is required that the lower end of the first shielding plate 252 is spaced from the feeding surface not less than a distance such that the toner image surface of the sheet S does not contact the first shielding plate lower end (for example, the distance is not less than 10 mm). Further, the reflected light by the sheet S passes through a portion which is lowest and remotest in the case where the radiation angle from the UV radiation irradiation source is θ degrees (for example 60 degrees) when the optical axis center is taken as 0 degrees, and in order to shield with the first shielding plate the reflected light of the UV radiation (light), emitted with the radiation angle of θ degrees, by the sheet S, the following relationship is satisfied.

$$Y2<(X-Y1\times\tan\theta)\times\tan(90-\theta),$$

where Y1 if a distance between the UV irradiation device 25 and the feeding surface with respect to a perpendicular direction to the feeding surface, Y2 is a distance from the feeding surface to the lower end of the first shielding plate 252 opposing the feeding surface, and X is a distance between the first shielding plate 252 and the UV irradiation device 25 with respect to the feeding direction.

Accordingly, the distance Y2 from the feeding surface to the lower end of the first shielding plate 252 is set so as to satisfy:

$$(\text{Distance in which toner image surface of sheet does not contact first shielding plate})<Y2<(X1-Y1\times\tan\theta)\times\tan(90-\theta).$$

On the other hand, for example, in the case where the reflected light passes through under the first shielding plate 252 with an angle thereof with the feeding surface which is not more than an angle determined by a radiation angle of the irradiation source (for example, the reflected light passes with an angle not more than an assumed angle due to occurrence of a partial float or the like of an attitude of the sheet S relative to the feeding surface), when the reflected light passes through under the first shielding plate 252 in a direction toward the intermediary transfer belt 20, the reflected light is blocked (shielded) by a second shielding plate 253 provided substantially parallel to a surface of the intermediary transfer belt 20 downstream of the nip N. In the case where the first shielding plate 252 is formed of the UV absorber, the second shielding plate 253 may return the reflected light toward the first shielding plate 252 or the UV irradiation device 25 (and the returned reflected light is absorbed by the first shielding plate 252), and therefore, the second shielding plate 253 may also be formed of a material which is not the UV absorber unless the material permits transmission of the UV radiation to the intermediary transfer belt 20 side, and may be formed of metal (iron), for example. It is desirable that the second shielding plate 253 is formed of a black body (having light absorptivity and low reflectance) absorbing and reducing energy of the reflected light. For example, the second shielding plate 253 is formed of iron subjected to black coating (painting) or black plating (such as black nickel plating).

In this embodiment, the first shielding plate 252 is formed of the UV absorber, but similarly as in the second shielding plate 253, may also be formed of the black body absorbing and reducing the energy of the reflected light (the light absorptivity of the black body is 90%-98% in general). In that case, the reflected light may be required to be reflected plural times by the first shielding plate 252 (when the light absorptivity is 90%, reflected light energy is reduced to $1/10$ by once of reflection and is reduced to $1/10 \times 1/10 = 1/100$ by twice of reflection, i.e., is reduced to $1/10$ to the 10th power) when the number of times of reflection is 10), and for example, the reflected light can be reflected plural times by the first shielding plate 252 by increasing a distance from the feeding surface to the ceiling wall of the cover 251 at the feeding portion 24. Or, an outer wall of the UV irradiation device 25 is formed of the black body similarly as in the first shielding plate 252, and the reflected light may also be reflected plural times between the UV irradiation device 25 and the first shielding plate 252.

Further, in this embodiment, in order to prevent the leakage light of the reflected light, the feeding portion 24 is provided with the cover 251, but for example, in the case where the image forming apparatus is constituted by a casing divided into a first casing including an image forming portion including the intermediary transfer belt 20 and a second casing including the UV irradiation device 25, the leakage light may also be prevented by a frame of the second casing or an outer casing. Further, a frame surface of either one of opposing surfaces of the first casing and the second casing or an outer casing surface may also function as the first shielding plate 252.

According to the constitution of this embodiment, it becomes possible to prevent the intermediary transfer belt 20 to be exposed to the light, reflected by the sheet S, emitted from the UV irradiation device 25.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-161730 filed on Aug. 25, 2017, which is hereby incorporated by reference herein in its entirety.

What is claimed is:

1. An image forming apparatus comprising:

an image forming portion including an image bearing member, a developing device configured to form a toner image on said image bearing member with a liquid developer including toner, and an intermediary transfer belt onto which the toner image is transferred from said image bearing member;

a feeding device including a feeding belt configured to feed a recording material on which the toner image is transferred from said intermediary transfer belt, while carrying the recording material on a surface thereof;

an ultraviolet irradiation portion arranged with said intermediary transfer belt in a horizontal direction while opposing said feeding belt and configured to irradiate the toner image, with ultraviolet radiation, formed on the recording material carried on said feeding belt;

a cover provided below said image bearing member with respect to a vertical direction and configured to cover at least a feeding surface of said feeding belt between said ultraviolet irradiation portion and said intermediary transfer belt with respect to a feeding direction on a side where said cover opposes said ultraviolet irradiation portion;

a first shielding plate extending in a direction perpendicular to the feeding direction on said feeding surface from an inner surface of said cover downwardly with respect to the vertical direction and configured to shield said intermediary transfer belt from the ultraviolet radiation toward said intermediary transfer belt; and a second shielding plate provided on said cover while facing said intermediary transfer belt and extending downwardly with respect to the vertical direction along an outer surface of said intermediary transfer belt, wherein said second shielding plate is configured to shield said intermediary transfer belt from the ultraviolet radiation toward said intermediary transfer belt.

2. An image forming apparatus according to claim 1, wherein the following relationship is satisfied:

$$Y2<(X-Y1\times\tan\theta)\times\tan(90-\theta),$$

where a distance between said ultraviolet irradiation portion and said first shielding plate with respect to the feeding direction is X, a gap between said feeding surface and said ultraviolet irradiation portion is Y1, a gap between said feeding surface and a free end of said first shielding plate with respect to the vertical direction is Y2, and an ultraviolet irradiation angle from a center of a light source of said ultraviolet irradiation portion is θ.

3. An image forming apparatus according to claim 1, wherein said first and second shielding plates have black surfaces.

4. An image forming apparatus according to claim 1, wherein said first shielding plate is formed of a resin material including an additive for absorbing a wavelength of the ultraviolet radiation.

* * * * *